United States Patent [19]

Russell

[11] Patent Number: 4,963,327

[45] Date of Patent: Oct. 16, 1990

[54] OXYGEN GENERATING MODULE

[75] Inventor: Donald H. Russell, Cherry Hill, N.J.

[73] Assignee: Z-Gard, Inc., Kansas City, Mo.

[21] Appl. No.: 173,113

[22] Filed: Mar. 23, 1988

[51] Int. Cl.[5] ..... A62B 7/08; A62B 21/00; A62B 23/02

[52] U.S. Cl. ..... 422/120; 422/122; 422/305; 128/202.26; 128/203.21; 128/205.28

[58] Field of Search ..... 422/120, 122; 128/202.26, 204.13, 203.21, 205.28, 206.12, 206.17, 206.22

[56] References Cited

U.S. PATENT DOCUMENTS

| | | | |
|---|---|---|---|
| 1,111,055 | 9/1914 | Carveth | 423/230 |
| 3,443,906 | 5/1969 | McGoff et al. | 422/122 |
| 3,565,068 | 2/1971 | Bickford | 128/201.25 |
| 3,806,323 | 4/1974 | Thompson | 422/122 |
| 3,893,459 | 7/1975 | Mausteller et al. | 128/202.26 |
| 3,992,317 | 11/1976 | Brichard et al. | 252/186.32 |
| 4,112,048 | 9/1978 | Mascher | 423/210 |
| 4,168,706 | 9/1979 | Lovell | 128/204.17 X |
| 4,490,272 | 12/1984 | Malafosse et al. | 422/120 |
| 4,534,775 | 8/1985 | Frazier | 422/122 X |
| 4,582,054 | 4/1986 | Ferrer | 128/200.23 |
| 4,717,549 | 1/1988 | Malafosse et al. | 422/120 |

OTHER PUBLICATIONS

Haigh, Frank; "A New Concept in Life Support System", Aircraft Engineering, 1982.

Hogan, Brian J., Design News, pp. 58–59, Jan. 8, 1979.

Gessner, David M., "New Developments in Oxygen-Therapy Equipment for Home Use", Respiratory Therapy, Mar./Apr. 1978.

*Primary Examiner*—Robert J. Warden

*Assistant Examiner*—Jeffrey R. Snay

*Attorney, Agent, or Firm*—Hedman, Gibson, Costigan & Hoare

[57] ABSTRACT

Apparatuses and methods for selectively absorbing undesirable organic and inorganic vapors and gases from ambient air while providing oxygen level enhancement of the treated air are disclosed.

14 Claims, 9 Drawing Sheets

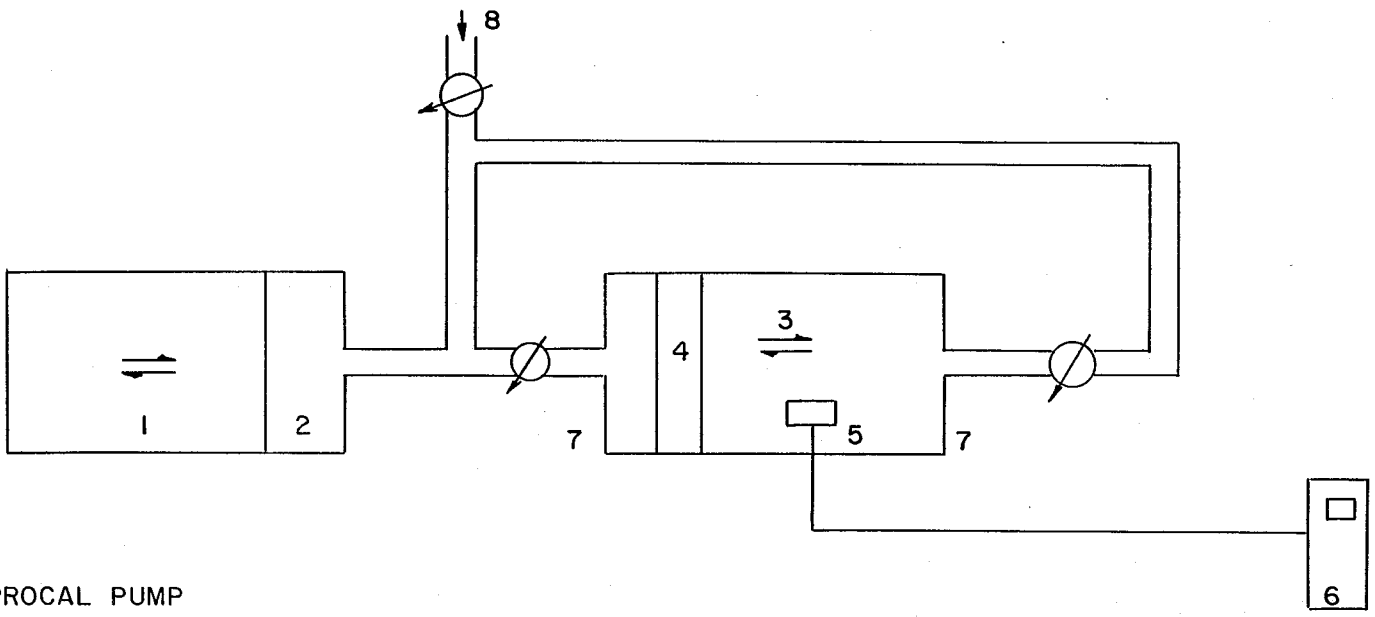

INTERNAL VOLUME, TOTAL SYSTEM - 1.15 LITER
FILTER SIZE - 3 1/2" DIAMETER/ 3/4" THICKNESS
CHEMICAL SAMPLE WEIGHT - 3-5 GRAMS
AIR VOLUME / INJECTION - 500-600 cc
PUMP RATES - 2 SECS/ CYCLE
4 SECS/ CYCLE
8 SECS/ CYCLE

1. RECIPROCAL PUMP
2. GAS RESERVOIR
3. TEST CHAMBER
4. FILTER WITH TEST MATERIALS
5. $O_2$ LEVEL DETECTOR, MSA MODEL 245RA
6. DIGITAL READOUT OF $O_2$ LEVEL
7. FLEXIBLE END FACES OF TEST CHAMBER
8. AIR SAMPLE INLET

FIG. 5

OXYGEN GENERATING MODULE

BACKGROUND OF THE INVENTION

The present invention relates to an apparatus and method for use in respirator masks and/or rebreather hoods for absorbing noxious gases and providing an adjustable oxygen output and carbon dioxide consumption from an "at rest" level up to a high stress level, such as that which occurs during heavy work conditions.

Many devices, including respirators and rebreathers, are well known in the art whose function is to provide oxygen and absorb carbon dioxide for various uses, including health care applications, and to protect a user from airborne gaseous contaminants from fires, etc.

Such devices employ various strong chemical and physical absorbants in order to remove contaminants from gaseous or liquid streams. Chemically reactive compounds such as soda lime (ascarite) and anhydrous lithium hydroxide are carbon dioxide absorbers which are widely used. Chemical oxygen sources such as chlorates, peroxides, and alkali metal superoxides are also well known. Physical absorbents include for example, activated carbons, zeolites, silicas, aluminas and ion exchange resins.

Most devices are limited by the rate at which they provide oxygen and the conditions under which they can be used. In addition, these devices are not designed to protect the user against all types of airborne contaminants which the user may encounter. For instance, recent publications show that there are long-lived free radicals which are present in the smoke from burning organic materials. These free radicals can react with lung surfaces if they are inspired and thereby cause severe damage and even death.

Respirators commonly use cartridge-type filters containing selective absorbents for noxious gases and inspired air. These devices are designed to remove undesired chemicals and particulate matter from incoming air, enhance the oxygen level within the mask, and eliminate carbon dioxide, either directly or in conjunction with mechanical check valves. Respirators are useful only when ambient oxygen levels are at least 19.5%. For oxygen levels below this level, separate mechanical supplies of air or oxygen are used, such as tanks of compressed gases, or remote source air pumping. These devices are bulky and complicated, and the user must be trained in their proper use.

Rebreathers are a separate class of emergency use respirators, usually in hood form, which are designed to continuously absorb or remove respired carbon dioxide, and excess moisture. Rebreathers obtain their air supply from that which is trapped when the user puts on the hood. Anhydrous lithium hydroxide is often used to absorb the respired carbon dioxide. However, rebreathers have limited service life because oxygen levels are not replenished. Compressed air devices are prone to mechanical problems with release valves and the user is required to operate them properly under life-threatening conditions.

Rebreathers using moisture activated alkali metal and alkaline earth metal superoxides and the like as both an oxygen source and a carbon dioxide absorber have been tested extensively. Basically, these chemicals react readily with moisture in respired air and evolve oxygen, while at the same time providing a reaction product which will absorb carbon dioxide. Potassium superoxide is especially useful for this purpose and has been employed in many respiratory devices. However, several problems have prevented their full commercial development. One problem is a delay or start-up period which occurs before oxygen delivery begins. Also, the practical size and operating conditions of these devices place limitations on the quantities of functional chemicals and the design geometry in which they are used. Additionally, oxygen output efficiency declines significantly as the breathing rate increases. Therefore, at high stress levels, the moisture content of the respired air is inadequate to generate the necessary oxygen levels.

The above problems have been addressed in several manners. For instance, a separate injectable water source has been tested, but not successfully. In addition, compacted briquettes of the superoxide are able to provide extended oxygen delivery times, and the use of large quantities of the same are able to over-ride the efficiency loss. However, the resulting exothermic heat of reaction with water is sufficient to require external heat exchangers on the superoxide cannisters. Under these conditions, the rebreather must be physically separated from the chemical source for obvious safety reasons.

In addition to the above devices, synthetic and natural zeolites of certain composition and porous sizes are used in pressure swing absorption devices to produce commerically high purity oxygen from air. Zeolites are a family of crystalline hydrated alumino-silicate minerals, with the general formula $MN_2O\text{-}Al_2O\text{-}nSiO_2\text{-}mH_2O$ where M is calcium, strontium or barium and N is either sodium or potassium. The ability of zeolites to function as molecular sieves, separating complex gas mixtures into various components is derived primarily from the highly uniform porous structure of the zeolite crystal which is a 3-dimensional network of interconnecting cavities. Large polar molecules are retained on the zeolite by Van der Waals forces rather than chemical bonding, while smaller and less polar molecules are not.

Air pressure well above atmospheric is required for the efficient operation of the zeolite system. In addition, since zeolites are both powerful dessicants and selective gas absorbants, the air must be pre-dried, or large excesses of zeolite must be used in order to compensate for the moisture in ambient air. In its practical use as an oxygen concentrator, the air is compressed and passed through a column of zeolite material. The more polar components of air, i.e., water vapor, carbon dioxide, and such pollutants as carbon monoxide, sulfur dioxide, nitrogen oxides, and hydrocarbons are immediately absorbed on to the uppermost layer of the zeolite, the nitrogen fraction is selectively removed, leaving oxygen, traces of inert gases and some residual nitrogen. The zeolites are the active agents in many continuous generators of oxygen-enriched air for health care applications, for example for use with patients having severe chronic obstructive pulmonary disease (COPD).

In accordance with the above, it is an object of the present invention to provide an apparatus and method for selectively absorbing undesirable organic and inorganic gases and vapors from ambient air while providing oxygen level enchancement of the treated air which is more efficient than prior are methods and devices.

It is another object of the present invention to provide unique modifications of the chemical materials commonly used in such systems to provide extended and controlled oxygen production and utilization efficiencies that allow for major reductions in the sizes and weights of the components.

It is a further object of the present invention to provide unique designs of component configurations and arrays in order to make them compatible with established breathing mask structures of both respirator and rebreather types and which can also be used in ventilating applications.

It is another object of the present invention to provide an apparatus and method which allows the activation of an oxygen generating system on demand.

It is yet another object of the present invention to provide an oxygen enrichment system which is simple and inexpensive to manufacture, safe and easily disposed after use.

It has now been surprisingly discovered that by combining the use of the above-mentioned compounds in a unique manner, the efficiency gain is much greater and different from an additive effect of each of the components.

SUMMARY OF THE INVENTION

Thus, in accordance with the above-mentioned objectives, one aspect of the present invention relates to a multi-chamber permselective apparatus for providing oxygen-enriched filtered air matched to a range of breathing rates, comprising a first chamber containing microcapsules comprising an oxygen generating compound as a core material and a coating which is moisture swellable but not soluble, wherein the coating slowly exposes the core material to moisture when exposed to respired air, thereby allowing the core material to react with the moisture and generate oxygen; a second chamber containing a solid carbon dioxide absorber for absorbing carbon dioxide from respired air; a third chamber containing an aqueous solution of mildly acidic salt with a small amount of nonionic surfactant; and a fourth chamber containing aqueous hydrogen peroxide and a small amount of nonionic surfactant. The chambers are made from a semi-permeable fabric, which prevents fluid penetration under normal pressure but allows fluid to pass through under moderate overpressure. The invention also comprises a first pressure means for forcing the aqueous solution from the third chamber into said first chamber during faster breathing rates, and a second pressure means for forcing the aqueous solution from the fourth chamber into the first chamber during prolonged faster breathing.

In preferred embodiments, the multi-chamber permselective apparatus further comprises a fifth chamber also made from semipermeable fabric which contains an immobolized sorptive particulate material for selective absorption of noxious and other undesired gases which is cationically exchanged with a heavy metal ion.

In other preferred embodiments, the semi-permeable fabric is coated with an antioxidant. Alternatively, a sixth chamber may be included which includes an antioxidant. Preferentially, the antioxidant comprises 2,6-tert-butyl-p-cresol, propyl gallate, t-butylhydroxy quinone, a butylated hydroxyanisole or a mixture thereof.

This device is contemplated for use in respirator masks and/or hoods of the rebreather type. Each chamber of the device carries a different chemical and has a specific function. Overall, the device absorbs noxious gases and provides an adjustable oxygen output and carbon dioxide consumption matched to the oxygen demand of the user. Although the major function of the unit is to provide oxygen generation and carbon dioxide absorption matched to a range of breathing rates, it is also directed to selective gas absorption and free radical termination as secondary functions. The device is designed to provide user protection against airborne gaseous contaminents from fires in buildings, factories, aircrafts, mines, etc.

The present invention is also related to a filter for generating oxygen and absorbing noxious and other undesired gases comprising a plurality of layers including an immobilized sorptive particulate material which is cationically exchanged with a heavy metal ion, and at least one layer comprising an oxygen generating compound, said oxygen generating layer being in juxtaposition with said layers of immobilized sorptive material layers.

The present invention is also related to a method for generating oxygen gas comprising adding a strongly basic compound and an oxygen generating material which is substantially completely free of heavy metal salts to a solution comprising aqueous hydrogen peroxide substantially completely free of heavy metal salts and thereafter contacting the solution with a composition containing a heavy metal in elemental form to generate oxygen gas. The oxygen generating material dissolves in the solution, thereby raising the pH, and the aqueous hydrogen peroxide decomposes to water and oxygen upon contacting the heavy metal. This double decomposition procedure has advantages over prior art methods of generating oxygen through the use of either component alone because of an unexpectedly higher oxygen delivery capacity than an additive effect would dictate.

In preferred embodiments, the oxygen generating compound comprises potassium superoxide, lithium superoxide, magnesium peroxide, calcium peroxide, sodium peroxide calcium peroxide, lithium superoxide, potassium peroxide, or a mixture thereof and the immobilized sorptive particulate material comprises a copper or iron exchanged clinoptilolite or mordenite.

The novel devices and unique modifications of the chemical materials used herein provide extended and controlled oxygen production and utilization efficiencies which allow for major reductions in the sizes and weights of the components. Other advantages occur in manufacture, safety and disposal. In addition, the present invention may be used in ventilating applications or alternatively in breathing masks of both the respirator and rebreather type.

BRIEF DESCRIPTION OF THE DRAWINGS

The following drawings in which like reference characters indicate like parts are illustrative of embodiments of the invention are not meant to limit the scope of the invention as encompassed by the Claims.

FIG. 5 is a schematic view of a test apparatus comprising a closed loop system for the present invention;

DETAILED DESCRIPTION

Figure 1:
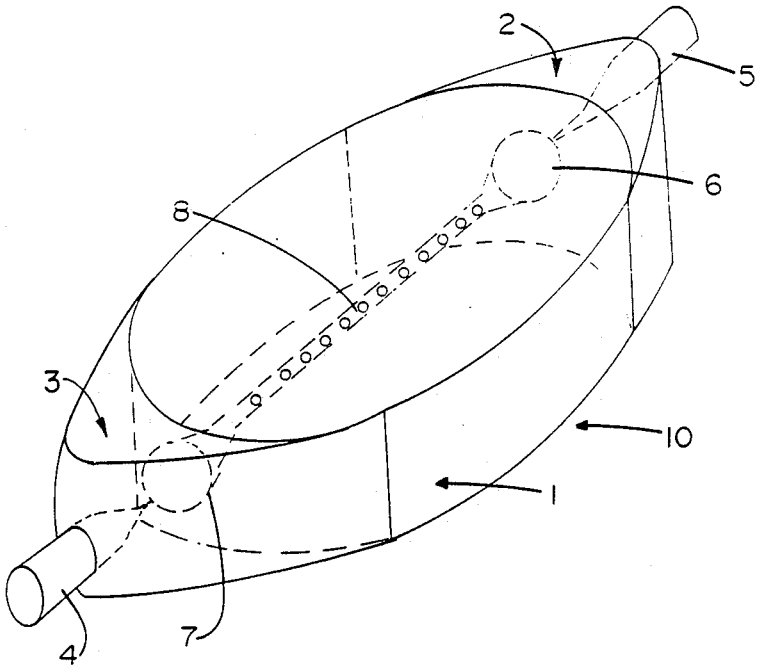
FIG. 1 is a cross-sectional view of a cartridge type apparatus of the present invention.

The present invention provides $O_2$ generation and $CO_2$ absorption matched to a range of breathing rates and also provides selective gas absorption and free radical termination. This is accomplished by providing different chemical components, having specific functions. The chemical components include: a solid oxygen generating compound reactable with water to form oxygen and which is microencapsulated in a wall material that is moisture swellable but not soluble; a solid $CO_2$ absorber; a cation exchanged zeolite; an aqueous solution of a mildly acidic salt with a small amount of nonionic surfactant; aqueous hydrogen peroxide preferentially of approximately 30 percent strength with a small amount of nonionic surfactant; and one or more antioxidants considered GRAS.

In brief, oxygen is derived from both the oxygen generating compound and the hydrogen peroxide. Carbon dioxide is absorbed by both LiOH and the reaction product of the oxygen generating compound and water. The zeolite is a selective absorbent for carbon monoxide and can also absorb other noxious gases such as $SO_2$ and NOX. In addition, as will be discussed in detail below, the combination of the microencapsulated oxygen generating compound, such as potassium superoxide, and zeolites cationically exchanged with heavy metal ions provide surprisingly high levels of oxygen. The antioxidants are scavengers for free radicals present, for example, in the smoke from fires. Aqueous $MgCl_2$ can be used as a source of additional water to increase oxygen release from the oxygen generating microcapsules and/or to decompose the alkaline reaction products from the same. The specific actions and reactions of these chemicals will be discussed below.

The multi-chambered unit to which the present invention is directed is made of a semi-permeable fabric. Each chamber carries a different chemical and each has a specific function. The term semi-permeable fabric is defined herein as a broad group of woven and non-woven materials whose physical structure is controlled to give breathability; that is, to allow passage of air but not liquids. Needle punching, leaching of dispersed soluble salts, fibrillation, and biaxial orientation are some of the well known methods for producing controlled porosity. There are many water repellent finishes for conventional porous fabrics that will render them semi-permeable. These finishes will prevent water penetration under normal pressure, but water can be forced through under moderate over-pressure. In this fashion the fabric can function as a pressure activated valve to admit liquids on demand. One material of choice is a widely used fabric called Goretex available from W. L. Gore Co., which is an oriented, microporous teflon composite. Other acceptable semi-permable fabrics include CT breathable film, available from Consolidated Thermoplastics Co. (an oriented, microporous polyurethane), and water resistant nylons and canvases available from various suppliers.

The chambers will vary is size and volume depending on the required level and duration of performance. The largest chamber will be the peroxide holder, and it will contain one or more microencapsulated solid oxygen generating chemicals.

Various geometric shapes and designs are possible. Two of these possible designs have been selected for purposes of example. The first is a disc shape similar to the filter cartridge units commercially sold for respirator masks. It would be used in a face mask in which air is reversibly forced through the filter by breath action (Dynamic air flow). The second type is a free standing absorber pad for a hood type rebreather in which breathing causes air circulation. Device activation occurs by permeation and diffusion (passive or semi-static air flow).

Referring to FIG. 1, the cartridge type model 10 consists of 3 chambers arranged in sandwich fashion and made of Goretex fabric. The layers may be separate or mutually attached and housed for convenience and handling in a rigid, open-grid container made of polypropylene, high impact polystyrene, or other impact resistant thermoplastic.

Attached to the circumference of the outside edge of the microcapsule chamber 1 are either one or two elastomeric chambers for reactive liquids. In the embodiment herein depicted, chamber 2 contains a reservoir of aqueous hydrogen peroxide, while chamber 3 contains a reservoir of a mildly acidic salt such as aqueous $MgCl_2$ solution, each with a small amount of nonionic surfactant. The liquid contents are kept separate from the microcapsules by means of frangible discs 6, 7 made of brittle, impermeable plastic such as polystyrene. Mounted onto and through the elastomeric walls are plungers 4, 5 which extends as studs or buttons outside the chamber and terminates in a sharp point inside the chamber and in proximity to the frangible discs 6, 7. The elastomeric material comprising the elastomeric walls may be any oxidation resistant rubber or elastomeric thermoplastic. A preferred material is neoprene.

Figure 2:
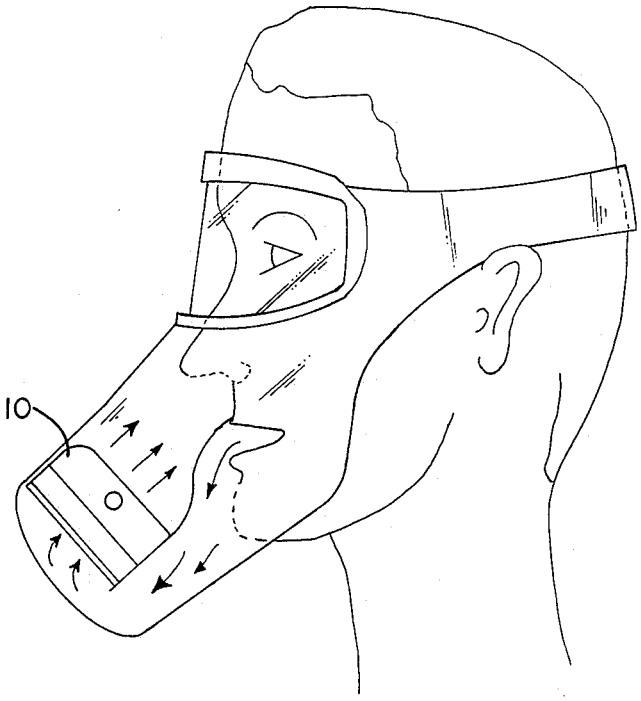
FIG. 2 is a perspective view showing the cartridge type apparatus of FIG. 1 a rebreather mask.

Depressing either plunger 4, 5 ruptures the respective frangible disc 6, 7 and allows the contained liquids to contact the outer wall of the microcapsule chamber 1. Repeated depressions of the plunger 4, 5 pumps the liquid through the wall by the overpressure technique previously described. Alternatively, the frangible discs 6, 7 can be backed by and a porous conduit 8. Porous conduit 8 is made of a porous material. In the present example, a porous plastic is molded into the walls of the microcapsule chamber 1 and extends transversely through the diameter of microcapsule chamber 1. In this embodiment, frangible discs 6, 7 are preferentially located at either end of porous conduit 8. FIG. 2 is a perspective view showing the cartridge module in place in a rebreather mask.

Figure 3:
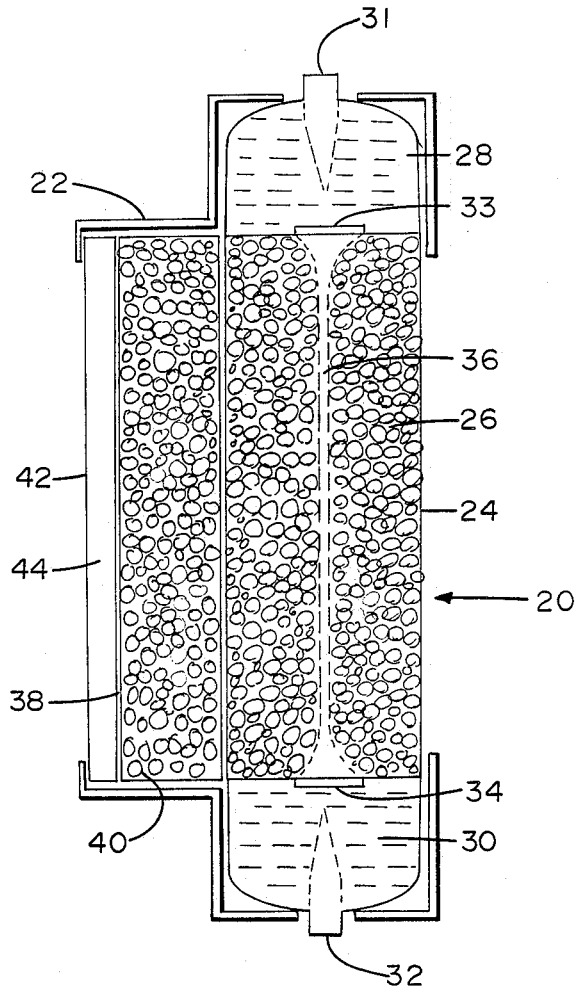
FIG. 3 is a cross-sectional view of a free standing absorber apparatus of the present invention.

FIG. 3 shows a free standing absorber module 20 for passive flow use for a hood type rebreather in which activation occurs by permeation and diffusion. The outer structure comprises a module holder which holds the multi-chambered unit. The module 20 comprises the microcapsule chamber 24 which contains one or more micro-encapsulated solid oxygen generating chemicals 26. Attached to the microcapsule chamber 24 at either end are either one or two chambers for reactive liquids. In the module herein depicted, reactive chambers 28 and 30 are arranged at either end and contain aqueous hydrogen peroxide and aqueous $MgCl_2$ respectively, each with a small amount of nonionic surfactant. Mounted onto and through module holder 22 are plungers 31, 32 which terminate in a sharp point inside chambers 28 and 30, respectively, and in proximity to frangible discs 33, 34. frangible discs 33, 34 are located at either end of porous conduit 36. Alongside microcapsule chamber 1 are two additional chambers. Chamber 38 contains a solid carbon dioxide absorber such as solid anhydrous LiOH particles 40, although any of the well known solid carbon dioxide absorbers may be substituted in its place.

Figure 4:
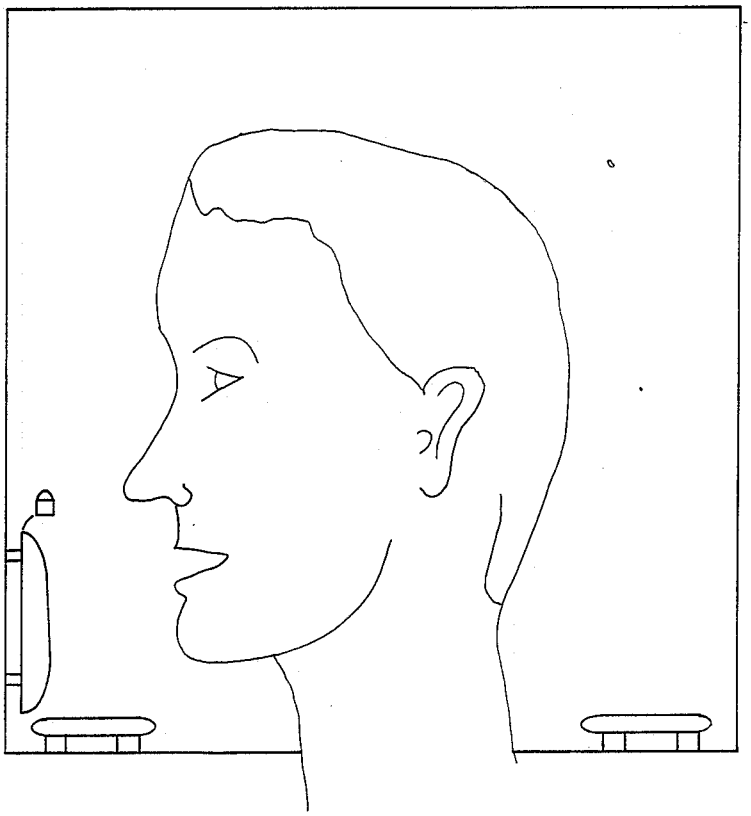
FIG. 4 is a perspective view showing the free standing apparatus of FIG. 3 within a rebreather unit.

Chamber 42 contains a copper or iron exchanged clinoptilolite or mordenite. FIG. 4 is a perspective view showing the free standing absorber module placed within a rebreather hood, for passive or static use with an alternate module.

Additionally, in preferred embodiments the present invention also includes antioxidants as scavengers for the free radicals either as a separate layer in the unit, or preferably as a coating on the semi-permeable fabric of the unit. The antioxidants are non-volatile under these use conditions and are not transferred to the air stream. Food grade antioxidants are used for safety. These antioxidants are used for safety. These antioxidants are commonly referred to in the art as GRAS antioxidants, and include 2,6-di-tertbutyl-p-cresol, propyl gallate, t-butyl hydroxy quinone, butylated hydroxyanisole, combinations of any of the foregoing, and the like.

The above devices have been designed in component configurations and arranged in order to make them compatible with established breathing mask structures. However, these configurations may be changed in manners apparent to those skilled in the art in order to make them compatible with new structures which may arise.

Although mechanisms have been provided herein for activating the system on demand, the chemicals and the multi-chambered unit as a whole function differently depending upon the breathing rate and the work level of the user. However, for the purposes of this disclosure, their function can be categorized into three breathing rate levels; namely, (1) slow or at rest, (2) fast breathing, and (3) high stress rate breathing. At condition, (1) typical oxygen demand is about 0.3 liter/min and $CO_2$ generation is 0.25 liter/min. As breathing and work rate increases, oxygen need greatly increases and $CO_2$ production rate increases faster than that of $O_2$ demand. At high stress rates, $CO_2/O_2$, are in balance, with both at a level of 2.5 liters/min or about 8.3 times the at-rest requirements.

The oxygen generating compound such as potassium superoxide and the like is a demand source of chemical oxygen. When this compound reacts with water, it forms potassium hydroxide which absorbs carbon dioxide. In the present invention, it is used in a microcapsule form having a very small particle size (approximately 250–1000 microns), since the bulk form of this compound is not adaptable to compact cartridge design. In bulk form, the compaction density of the potassium superoxide is relied upon to control permeation and diffusion of moist air and give extended release times. The small particle size provides a very reactive and large surface area when the capsules open. As these microcapsules are exposed to moisture, the coating slowly peels back in an exfoliating manner, exposing increasing amounts of the core material. Thus, unlike the bulk form, the active core material is available only in proportion to the number of capsules "opened" by incoming moisture.

The microencapsulated oxygen generating material generally comprises a core material comprising an oxygen generating compound and a coating comprising an acceptable wall-forming water swellable polymer, and are disclosed in U.S. Pat. No. 4,867,902, filed on, 1988, the assignee of record, and incorporated herein by reference in the interest of brevity.

Preferably, the core material comprises one or more of the alkali and alkaline earth peroxides, superoxides, trioxides, percarbonates or permanganates. Most preferably, the core material is comprised of potassium superoxide.

The water swellable coating preferentially comprises a copolymer of an olefin such as ethylene, propylene, isobutylene, or styrene and a vinyl compound such as vinyl acetate, vinyl alcohol, the alkyl, hydroxyalkyl and amino alkyl acrylic and methacrylic esters, maleic anhydride, maleate esters, maleate salts, vinyl alkyl ethers, vinyl pryidive, vinyl pyrollidone, and vinyl sulfonic acid, esters and salts; homopolymers of the above-mentioned vinyl monomers, acrylics and maleic anhydrides; anhydrous polymeric alkylene oxide polyols and alkoxy derivatives having a molecular weight greater than 500; gelatins; starches; gums; polyamides; polyurethanes modified for high hydroplilicity; and mixtures of any of the foregoing.

The microcapsule coating may also comprise one of the combustion resistent coatings disclosed in previously mentioned U.S. Pat. No. 4,867,902.

At slow breathing rates, respired moisture causes the microcapsule coating to swell and peel back in the previously mentioned exfoliating manner, thus allowing water to react with the oxygen generating compound. Although the reaction between the oxygen generating compound and water differs slightly depending upon whether the oxygen generating compound is in the peroxide, superoxide, trioxide, etc., form, the end result is substantially the same in that oxygen is generated and the resultant alkali or alkaline earth hydroxide thus formed absorbs carbon dioxide. The various reactions are set forth in Table 1.

TABLE 1

| Reactions of the Oxygen Generating Compounds | |
|---|---|
| Compounds: | Peroxides - $M_2O_2$ |
| | Superoxides - $MO_2$ |
| | Trioxides - $M_2O_3$ |
| Reaction with $H_2O$ ($O_2$ evolution) | |
| $2M_2O_2 + 2H_2O \rightarrow 4MOH + O_2$ | |
| $2MO_2 + H_2O \rightarrow 2MOH + 3/2O_2$ | |
| $M_2O_3 + H_2O \rightarrow 2MOH + O_2$ | |
| Reaction of $CO_2$ with Hydroxide (MOH) | |
| $MOH + CO_2 \rightarrow MHCO_3$ | |
| $2MOH + CO_2 \rightarrow M_2CO_3$ | |

Since the oxygen generating particles emerge on a gradual or timed basis, there initially are not enough available particles to absorb all of the carbon dioxide present. Accordingly, an additional chamber containing solid anhydrous lithium hydroxide is provided as a supplementary carbon dioxide absorber. As the breathing rate increases (thereby increasing the moisture present), the microcapsules open more rapidly, and the lithium hydroxide serves a secondary role.

For fast breathing rates, hereafter referred to as a first breathing rate, it is necessary to provide more moisture to the microcapsules than the amount obtained from respiration. In this case, an aqueous solution of $MgCl_2$, with a small amount of surfactant is pumped into the microcapsule chamber from an attached reservoir. Oxygen evolution and gas flow become very rapid and diffusion of carbon dioxide to the oxygen generating sites is inhibited. Lithium hydroxide is the primary carbon dioxide absorber. The contained surfactant aids in wetting the organic capsule surfaces. The $MgCl_2$ serves two functions; namely, as an anti-freeze and as a decomposition agent for the alkaline salts from the oxygen generating compound/water/carbon dioxide reaction An insoluble gel of magnesium hydroxide/carbonate is formed together with pH neutral salt, such as potassium chloride when potassium oxides are used.

Instead of $MgCl_2$, other well known salts in the art which provide signficant freezing point depressions in aqueous solutions and which form substantially insoluble compounds when reacted with alkali hydroxides and/or carbonates may be used. Examples include $CaCl_2$, $FeCl_3$ and $ZnCl_2$.

For high stress breathing rates, hereafter referred to as a second breathing rate, the oxygen requirements are supplied by both the microencapsulated oxygen generating compound and hydrogen peroxide. In this situation, aqueous hydrogen peroxide (30 percent strength, for example) containing surfactant is pumped from its reservoir to the microcapsule chamber. A double decomposition reaction occurs which comprises the reaction of the oxygen generating compound (i.e., potassium superoxide) with aqueous hydrogen peroxide, and subsequent metal catalyzed decomposition of the resulting metastable alkaline aqueous hydrogen peroxide. For purpose of the present disclosure, metastable means chemically unstable, but not liable to spontaneous rapid decomposition.

The double decomposition procedure has the advantage of higher oxygen delivery capacity than either system alone. The individual chemical reactions are as follows:

$$KO_2 + 2H_2O \rightarrow 2KOH + O_2$$

$$2aq.H_2O_2 \rightarrow 2H_2O + O_2$$

Overall, the simplified reaction is:

$$KO_2 + 2aq.H_2O_2 \xrightarrow{metal} aq.KOH + 2\tfrac{1}{2}\,O_2$$

Specifically, the double decomposition reaction comprises the in situ formation of potassium hydroxide substantially free of heavy metal salts which dissolves in the aqueous hydrogen peroxide as the oxygen is being liberated, thereby raising the pH of the aqueous hydrogen peroxide from its normal range of pH 3–5 to its metastable range of pH 9–12. Gradual decomposition of the metastable hydrogen peroxide to oxygen and water then occurs, thus providing a secondary source of oxygen. The decomposition to water and oxygen has been found to be controllable by contacting the solution with solid metal surfaces.

As previously mentioned, the alkaline aqueous hydrogen peroxide is metastable. It is known in the art that metastable aqueous hydrogen peroxide decomposes rapidly and uncontrollably in the presence of soluble heavy metal salts. However, only chemically pure alkalis can be used to make metastable aqueous hydrogen peroxide, since metal salt impurities are sufficient to cause decomposition.

Microfine silver and samarium catalysts are used to promote the violent and instantaneous decomposition of concentrated hydrogen peroxide into oxygen and steam. It has use for propulsion of rocket sleds and related devices, but is not suited for controlled release systems. It has been found that solid forms (rods, wires, screens) made of any of stainless steel, copper, iron, carbon steel, silver, nickel, or chromium initiate oxygen release from metastable aqueous hydrogen peroxide. Removal of metal source stops the oxygen release, and it can be re-started repeatedly by replacing the metal catalyst.

Once again, the gas flow rates which occur during this prolonged high stress rate operation are such that the lithium hydroxide becomes the primary carbon dioxide absorber. Optionally, the $MgCl_2$ solution can be used to neutralize the alkaline reaction products when the oxygen release is completed and the unit is to be disposed of.

In addition to the advantages provided by the multichambered unit in regard to the increased oxygen release provided by the double decomposition reaction discussed above, the present invention has a further novel feature in that it has been found that the selective absorption of noxious and/or undesired gases and the extended controlled production and delivery of oxygen through the utilization of both physical means, i.e. zeolites cationically exchanged with heavy metal ions, and chemical means, i.e. superoxide/water reaction, in the unique compact form herein disclosed provides an efficiency gain which is much greater and different from an additive effect of these components. This result occurs with or without added anhydrous lithium hydroxide.

This result is totally unexpected given the fact that superoxides function only by reacting with water, while zeolites absorption capacity is deactivated by water. In addition, superoxides work well at atmospheric pressure whereas zeolites do not. One possible explanation for this phenomenon is that there is a complex interaction of absorption dynamics with small particle size and high specific absorbency chemicals. It may also include effects due to reduced competition for absorbency chemicals. It may also include effects due to reduced competition for absorption sites and gas transfer process.

More particularly, one possible explanation for this phenomenon could be a combination of the following: the increased surface area of the small oxygen generating particles can compensate for short gas/solid contact times required for efficient permeation and diffusion, thus effectively achieving a longer pathway; the hydrophobic zeolites function as selective gas absorbents rather than as dessicants; the lithium hydroxide in the unit functions exclusively as a carbon dioxide absorber and thereby decreases competition for carbon dioxide absorption sites in the zeolites; oxygen generation and carbon dioxide and the like is enhanced by the microencapsulated form (shorter diffusion pathways); and continuous generation of oxygen from the microcapsules in juxtaposition to hydrophobic zeolite surfaces causes a gas transfer phenomenon in which absorbed gases, i.e., nitrogen and carbon dioxide, are constantly displaced from the zeolites by oxygen, and then more effectively reabsorbed upon cycling through filter.

DESCRIPTION OF THE PREFERRED EMBODIMENTS

The following examples illustrate various aspects of the invention. They are not to be construed to limit the claims in any manner whatsoever.

EXAMPLES 1-6

Microcapsules comprising various oxygen generating core materials and a wall-forming water swellable coating were prepared in accordance to methods well known in the art (particle size 250-1000 microns), and their oxygen generating properties were tested. The results are shown in Table 2.

TABLE 2

Properties of $KO_2$ and Alternate Inorganic Oxides

| Core Compound (formula) | (MW) | % contained oxygen | lbs $O_2$/lb (generation) | lbs $CO_2$/lb* (absorption) |
|---|---|---|---|---|
| $KO_2$ | 71 | 45 | 0.34 | 0.31 |
| $K_2O_3$ | 126 | 38 | 0.25 | 0.35 |
| $Li_2O_2$ | 46 | 69.5 | 0.35 | 0.96 |
| $Na_2O_2$ | 78 | 41 | 0.21 | 0.56 |
| $NaO_2$ | 55 | 58 | 0.43 | 0.40 |
| $Ca(O_2)_2$ | 104 | 61.5 | 0.46 | 0.42 |

*calculated as carbonate

EXAMPLES 7-10

The properties of $MgCl_2$ and alternate salts used in the present invention as a source of additional water to increase oxygen release from the microcapsules and/or to decompose the alkaline reaction products from the same were tested at different weight percentage. The results are shown in Table 3.

TABLE 3

Properties of Mg $Cl_2$ and Alternate Salts

| Aq. solution (Percentage by weight of dissolved salt) | Freezing Point Depression (°C.) | | | |
|---|---|---|---|---|
| | $CaCl_2$ | $MgCl_2$ | $FeCl_3$ | $ZnCl_2$ |
| 1 | 0.44 | 0.55 | 0.38 | 0.45 |
| 3 | 1.33 | 1.62 | 1.13 | 1.25 |
| 5 | 2.36 | 2.97 | 1.90 | 2.19 |
| 7.5 | 3.93 | 5.14 | 3.16 | 3.78 |
| 10 | 5.85 | 7.91 | 4.77 | 5.52 |
| 15 | 11.0 | 15.64 | 9.33 | 9.83 |
| Solubility in water 20° C. (g/100 g $H_2O$) | | | | |
| Hydroxide | 0.10 | 0.009 | 0.001 | 0.001 |
| Carbonate | 0.0014 | 0.0106 | 0.001 | 0.001 |

EXAMPLE 11

A cartridge type module similar to that shown in FIG. 1 having chambers containing potassium superoxide microcapsules, anhydrous lithium hydroxide, cationic zeolite, a reservoir of aqueous of 30% strength hydrogen peroxide, and a reservoir of aqueous $MgCl_2$ was tested in order to determine its oxygen delivery capacity and its useful working life.

The dimensions of the individual chambers and their contents are provided in Table 4.

TABLE 4

DISK TYPE MODULE CHAMBER DIMENSIONS

| | Volume (CC) | Contained Wt. (GMS) | Diameter (In.) | Height (In.) |
|---|---|---|---|---|
| $KO_2$ Microcapsules | 163 | 86.2 | 4 | 0.8 |
| Anhydrous Lithium Hydroxide | 82 | 36 | 4 | 0.4 |
| Cationic Zeolite | 15 | 10 | 4 | 0.08 |
| 30% $H_2O_2$ | 30 | 30 | (a) | (a) |
| 10% aq $MgCl_2$ | 30 | — | (a) | (a) |

(a)Attached to the circumferential edge of the $KO_2$ microcapsules chamber. Length - 3" of circumference, width 0.8", Height - 0.75".

Upon activation, the oxygen delivery capacity was determined to be approximately 24 liters at 25° C. The useful working life depended upon the breathing rate of the user. At low stress (rest) breathing rates, the useful working life of the module was greater than 80 minutes. At high stress breathing rates, the useful working life was determined to be approximately 9-10 minutes.

EXAMPLES 12-14

Examples 12-14 are directed to the effect of the inclusion of solid metals in the double decomposition reaction and the effect of different forms of potassium superoxide.

In Example 12, powdered potassium superoxide was added to FMC 35% superD hydrogen peroxide (pH 3-5) and oxygen production was essentially immediate. The resulting alkaline mestable aqueous hydrogen peroxide (pH 9-12) showed no evidence of spontaneous oxygen release. Loops of 0.0625" diameter copper wire immersed in the liquid caused slow, steady gas evolution from the immediate wire surface. The test was repeated successfully with wires made from each of silver, iron, carbon steel, stainless steel, nickel, and chromium. The same metal wires placed in regular 35% hydrogen peroxide did not cause oxygen release.

In Example 13, microencapsulated potassium superoxide was used instead of potassium superoxide powder in a repeat of the tests from Example 1. The major difference observed was that oxygen release from potassium superoxide occured over an extended time period and the pH increase also occured gradually over the period of oxygen release. The various metals behaved as in Example 1.

In Example 14, Example 13 was repeated but with metal wires in place prior to introduction of the potassium superoxide microcapsules. As the pH gradually increased, there was an onset of gas evolution concurrently with the release from the reaction. The concurrent oxygen production started at about pH 8 and the aqueous hydrogen peroxide oxygen production rate increased continuously up to pH 12. An approximately overall uniform gas delivery resulted since the aqueous hydrogen peroxide rate accelerated as the potassium superoxide rate decreased.

Although potassium superoxide was used in these tests, other sources of alkali substantially completely free of metal salts can be used. It is preferred to use water reactive peroxides and superoxides since they liberate desired oxygen. The corresponding salts of potassium, sodium, and lithium are particularly useful because their hydroxides are strong bases and extremely water soluble.

The list of metals that catalyze the peroxide decomposition is not complete, and is not meant to be limiting.

EXAMPLES 15–35

The present invention of a modular unit having multi-chambers by which the combined ingredients provide a more efficient and compact system than previously possible is not readily treatable in quantitative terms since gas absorption dynamics in an environment of continuously changing conditions involves complex permeation and diffusion controlled parameters, in addition to other variable factors such as breathing rates, contact times with filter surfaces, atmospheric operating pressures, humidity, and changing gas compositions and temperatures.

Accordingly, a review of available standard tests showed that existing procedures were inadequate. Therefore, a special test device and method were developed to measure the performance of the materials in a simulated rebreather mode.

The test apparatus is shown schematically in FIG. 5 and consists of a closed loop system into which measured air samples can be introduced and recycled through a test filter by means of a pump and in contact with an oxygen level detector.

The test method comprises (1) introduction of a fixed amount of respired air to a reservoir 2 through an inlet valve 8, (2) starting recycle pump 1 after shutting inlet valve 8 and recording immediate change in $O_2$ level, (3) measuring the time and rate of $O_2$ recovery to ambient levels at a given pump rate. After quasiequilibrium is attained, the air sample is released and a new sample of respired air is injected and recycled as before. A total of 10 respired air injections were used for each filter assembly.

Test chemicals were sandwiched between layers of fiberglass mat, and held in the simulator device by an open grid rigid support. Respired air (18.2% $O_2$) at room temperature was the test gas. The rate of recovery of $O_2$ to ambient level (20.8%) was used as an indicator of filter performance, and changes in the recovery characteristics were used as capacity measures.

Recovery rate data are presented in graph form, and other data are given numerically as relative recovery times and total gas transport to achieve target $O_2$ concentrations.

Figure 6:
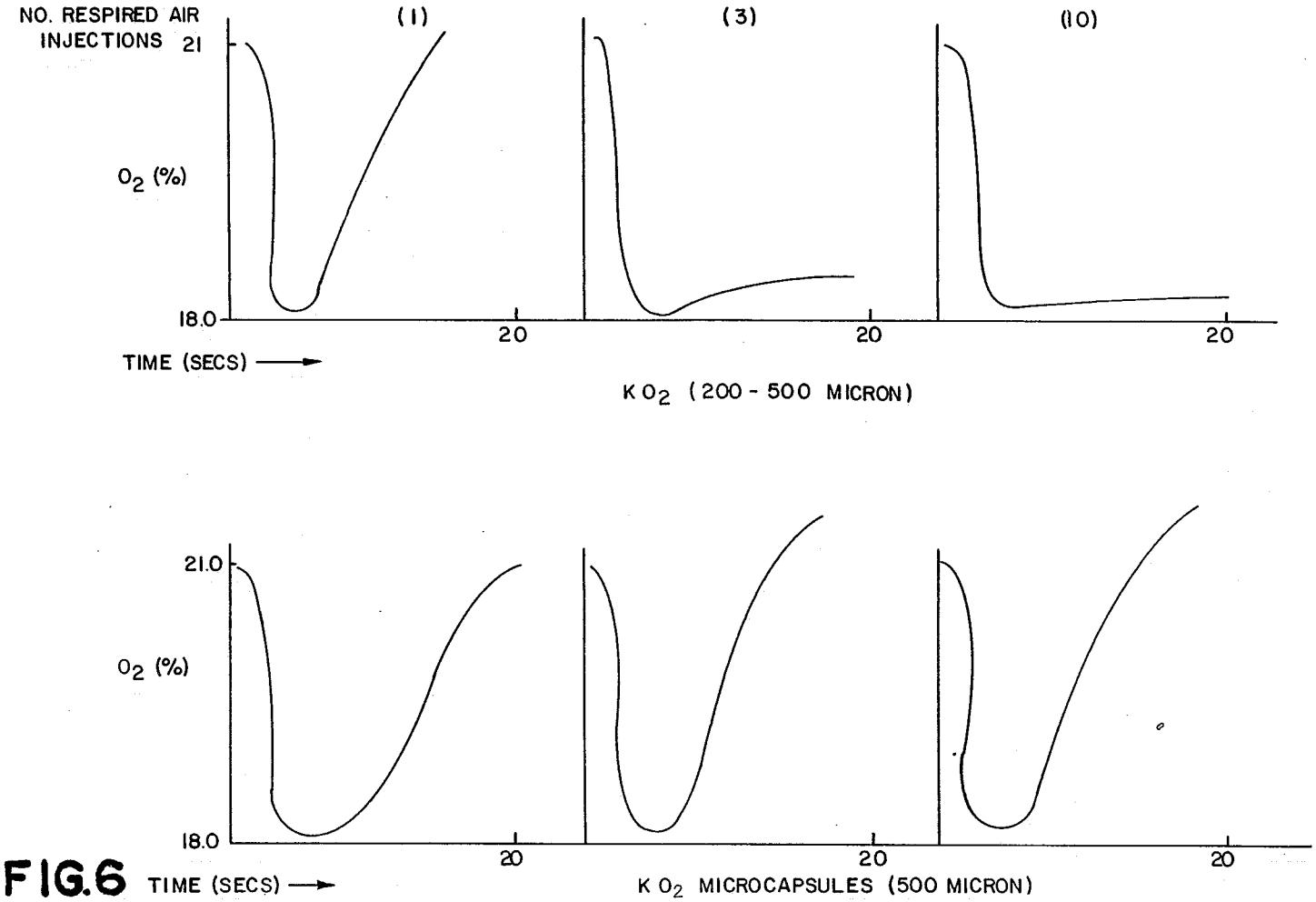
FIG. 6 is a graphical representation of the oxygen generation of microencapsulated potassium superoxide.

In Example 15, the oxygen generation of uncoated and microencapsulated potassium superoxide over a twenty second span was calculated on the basis of the percentage of oxygen in the air. The data for air injection 1, 3 and 10 are shown in the graphs provided in FIG. 6. From these graphs, it is readily apparent that extended controlled release of oxygen by the microencapulation is achieved even after 10 cycles.

Figure 7:
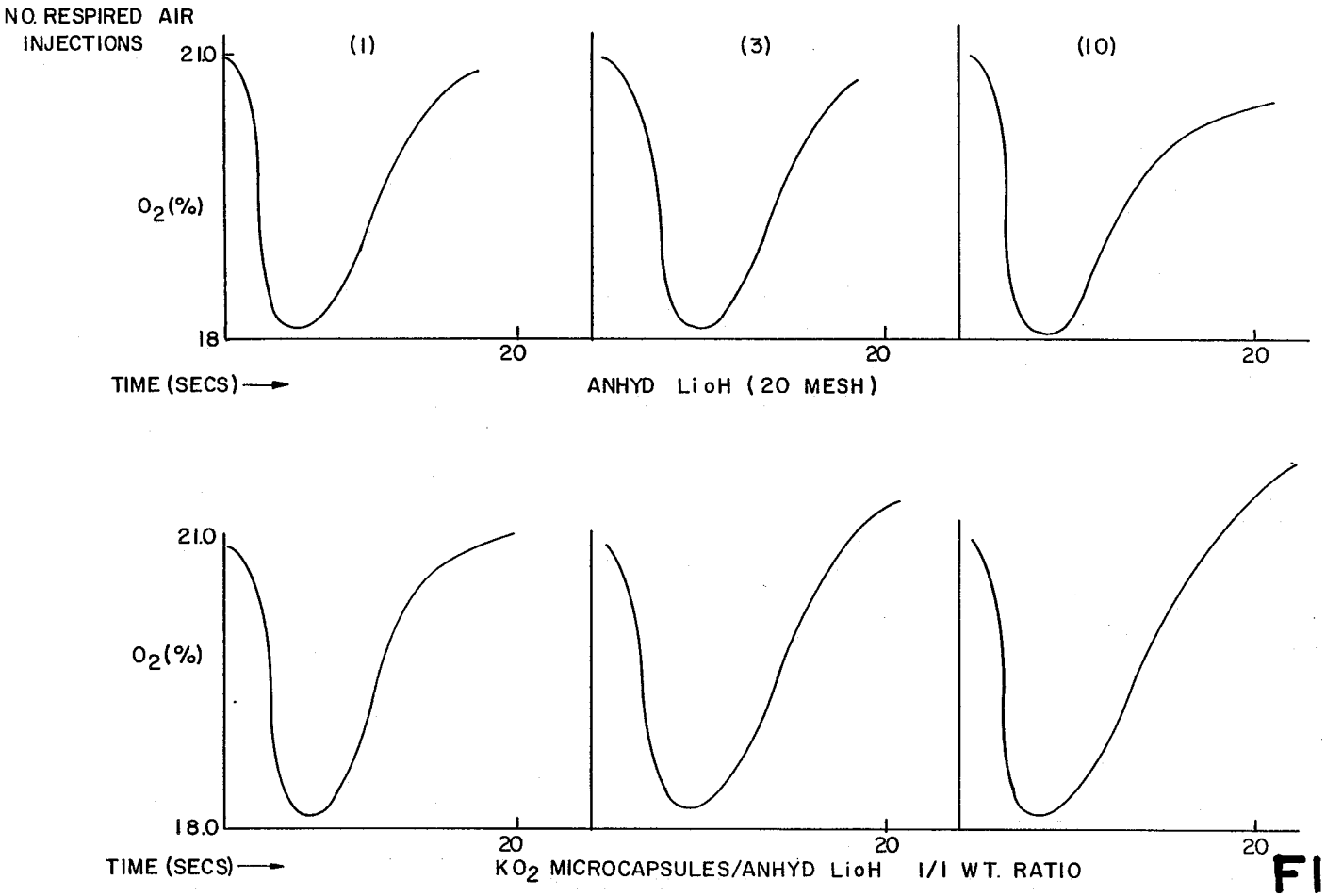
FIG. 7 is a graphical representation of a comparison of oxygen generation by lithium hydroxide alone against lithium hydroxide together with potassium superoxide microcapsules.

In Example 16, anhydrous lithium hydroxide alone (carbon dioxide absorber only) was compared to a system containing anhydrous lithium hydroxide and potassium superoxide microcapsules in a one-to-one weight ratio. The results are shown in FIG. 7.

The anhydrous lithium hydroxide alone showed decreased oxygen generating capacity on repeated air injections, while the potassium superoxide microcapsules and anhydrous lithium hydroxide together showed increased capacity due to sustained oxygen release.

In Example 17, a test material comprising cationic exchanged zeolite (iron mordenite) was compared against a 5A mole sieve (ued in pressure swing oxygen generation), and a 5A mole sieve which is coated with hydrophobic colloidal silica.

Figure 8:
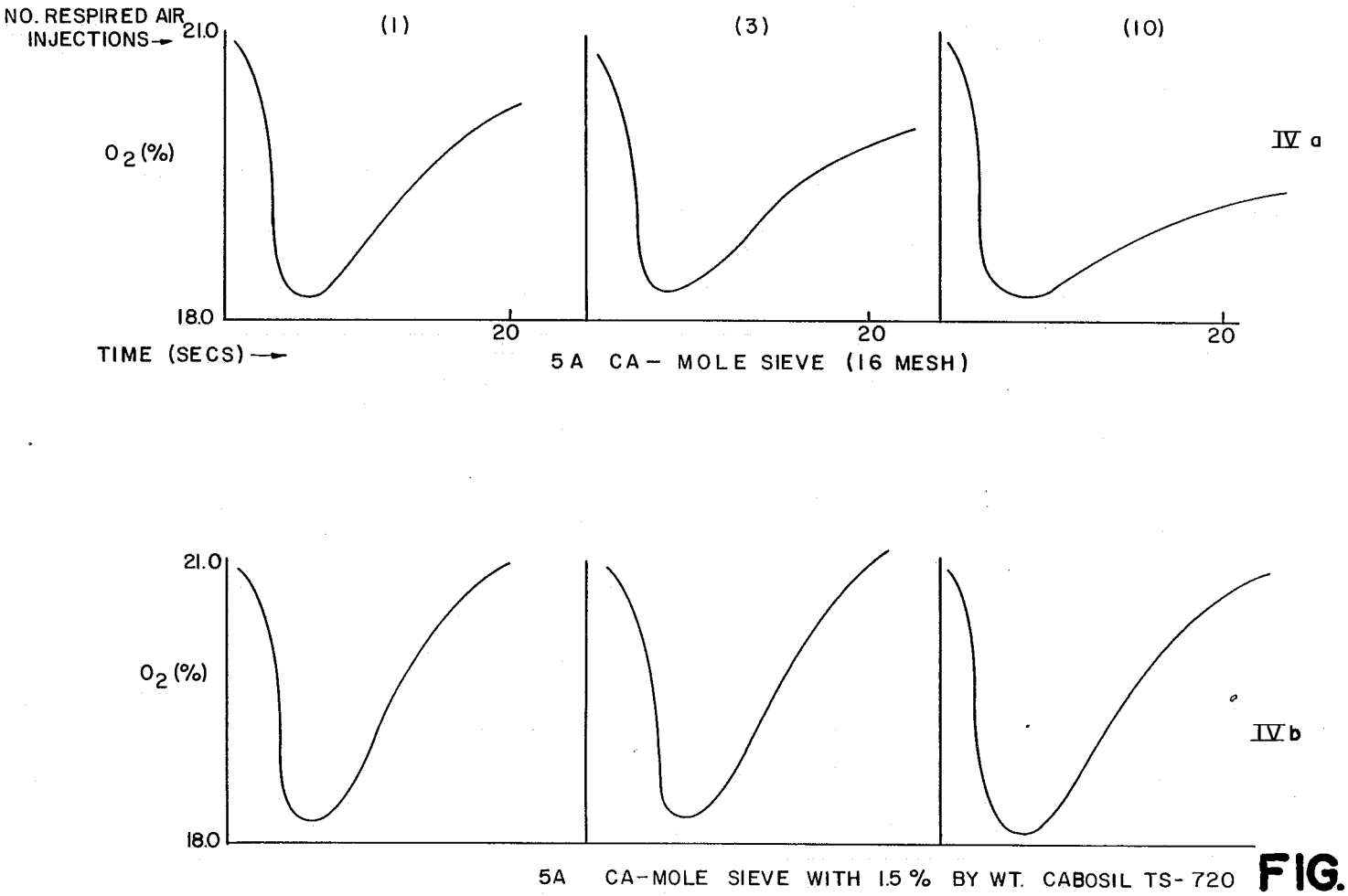
FIG. 8 is a graphical representation of a comparison of the effect of the presence of fumed colloidal silica on oxygen transport in a molecular sieve.

As can be seen from the graphs provided in FIG. 8, coating the 5A mole sieve with hydrophobic colloidal silica raises its performance to near that of the iron mordenite.

Figure 9:
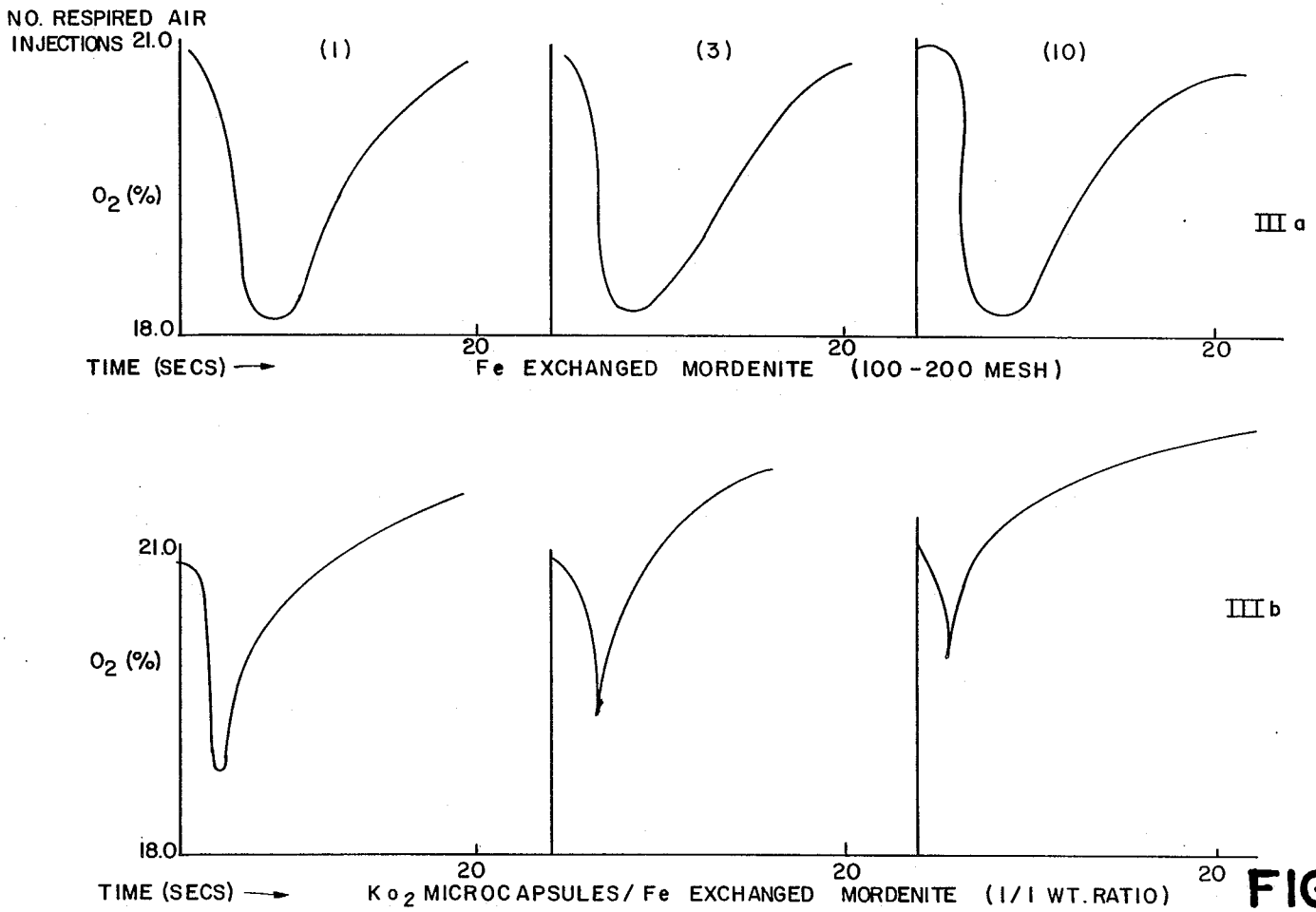
FIG. 9 is a graphical representation of a comparison of oxygen generation by a 5A mole seive coated with hydrophobic colloidal silica against iron mordenite.

In Example 18, a test material comprising iron exchanged mordenite was compared to a test material comprising both iron exchanged mordenite and potassium superoxide microcapsules. The results are shown in FIG. 9.

A comparison of the two sets of curves shows that the combination of iron mordenite and microencapsulated potassium superoxide gives lesser loss in immediate oxygen level on respired air injection and faster recovery to ambient conditions. Additive results from this combination of materials would be expected to yield curves similar to that for microencapsulated superoxides alone. These findings are novel and not predicted.

These results were confirmed by the further test results provided by Examples 19–27 which provide the relative recovery rates for the above-mentioned test materials for raising the oxygen level from 18.2 percent (corresponding to the oxygen level in respired air) to 19.5 percent. The results are shown in Table 5. Examples 28–35, provide the amount of respired air necessary to achieve 19.5 percent, 20 percent and 21 percent oxygen levels for certain of the above-mentioned test materials. The results are shown in Table 6. In addition, these results indicate that there is no essential differences by this test procedure between copper and iron as the heavy metal cation exchanged into mordenite. This result conflicts with literature references which suggest that the iron zeolites provide better selective gas absorption than the copper zeolites. Also, the microencapsulated potassium superoxide results in Table 6 show that there were lower total gas transport requirements for the gradual oxygen release to reach 21 percent (ambient air) oxygen levels than the other tested materials.

TABLE 5

| RELATIVE TIME[7] TO RAISE $O_2$ FROM 18.2% TO 19.5% | | |
|---|---|---|
| EXAMPLE | MATERIAL | SECONDS |
| 19 | 5A Mole Sieve[8] | 300 |
| 20 | 5A Mole Sieve w/1.5% TS-720[1] | 150 |
| 21 | Fe Mordenite[2] | 150 |
| 22 | Cu Mordeniie[3] | 150 |
| 23 | Anhydr. LiOH | 100 |
| 24 | $KO_2$ Microcapsules | 100 |
| 25 | Fe Mordenite/$KO_2$ Microcaps[4] | 20 |
| 26 | Fe Mordenite/$KO_2$ Microcaps/Anh. LiOH[5] | 20 |
| 27 | Anh. LiOH/$KO_2$ Microcaps[6] | 80 |

[1]Cabot Hydrophobic Colloidal Silica
[2]Cation Exchanged with $Fe(NO_3)_3$
[3]Cation Exchanged with $Cu(NO_3)_2$
[4]1/1 Weight Ratio
[5]1/1/1 Weight Ratio
[6]1/1 Weight Ratio
[7]Pump Rate = 8 Secs/Cycle
[8]Union Carbide 5AMG (Calcium Zeolite)

TABLE 6

| RESPIRED AIR (LITERS)[1] CYCLED THROUGH FILTER TO REACH OR EXCEED 19.5%, 20% and 21% OXYGEN LEVELS | | | | |
|---|---|---|---|---|
| EXAMPLE | MATERIAL | 19.5% $O_2$ | 20% $O_2$ | 21% $O_2$ |
| 28 | 5A Mole Sieve | 5–7.5 | 10 | 10 |
| 29 | 5A Mole Sieve w/1.5% TS-720 | 2.5 | 3.75 | 7.5 |
| 30 | Fe Mordenite | 1.25 | 2.5 | 7.5 |
| 31 | Cu Mordenite | 1.25 | 2.5 | 7.5 |

TABLE 6-continued

| RESPIRED AIR (LITERS)[1] CYCLED THROUGH FILTER TO REACH OR EXCEED 19.5%, 20% and 21% OXYGEN LEVELS | | | | |
|---|---|---|---|---|
| EXAMPLE | MATERIAL | 19.5% $O_2$ | 20% $O_2$ | 21% $O_2$ |
| 32 | $KO_2$ Microcaps | 1-1.25 | 2.0 | 5.0 |
| 33 | Anh. LiOH | 1-1.25 | 3.75 | 7.5 |
| 34 | $KO_2$ Microcaps/ Anh. LiOH | 1 | 2-2.5 | 5.0 |
| 35 | Fe Mordenite/ $KO_2$ Microcaps | 0.25 | 0.25-0.50 | 1.75-2.0 |

Pump Rate = 8 Secs/Cycle
[1]18.2% $O_2$

Although the primary focus of the present invention has been directed to respirator applications, it is contemplated that various aspects of the present invention, taken both individually and together, may be applied to many other applications. For example, the controlled gas absorption/release mechanisms of the present invention may be used for removal of toxic gases such as ammonia, carbon monoxide, sulfur dioxide and chlorine gas, and for removal of corrosive vapors such as hydrogen fluoride, hydrogen chloride, and sulfur trioxide. It may also be used for fruit ripening (release of ethylene) and water purification. In addition, it is contemplated this aspect of the present invention is suitable for use in fire extinguishers (for carbon dioxide, halon, etc.)

The controlled hydrophobicity aspects of the present invention may be used for inorganic cements, mortars and plastics, and for moisture reactives such as carbides, hydroxides and the like. It may also be used for gas absorption from aqueous or high humidity sources.

Finally, the moisture activated microcapsules of the present invention may also be used for other exo- and endothermic devices as well as for insecticides, fungicides, and the like.

The examples provided above are not meant to be exclusive. Many other variations of the present invention would be obvious to those skilled in the art, and are contemplated to be within the scope of the appended claims.

I claim:

1. A multi-chamber permselective apparatus for providing oxygen enriched filtered air matched to a range of breathing rates, comprising a first chamber containing microcapsules comprising an oxygen generating compound as a core material and a coating which is moisture swellable but not soluble, said coating slowly exposing said core material to moisture in respired air, said core material reacting with the moisture and generating oxygen;

a second chamber containing a solid carbon dioxide absorber for absorbing carbon dioxide from respired air;

a third chamber containing an aqueous solution of a mildly acidic salt and a nonionic surfactant;

a fourth chamber containing aqueous hydrogen peroxide and a nonionic surfactant, said chambers being made from a semi-permeable fabric, said fabric preventing fluid penetration under normal pressure but allowing fluid to pass through under moderate over-pressure, a first pressure means comprising a first plunger and a first frangible disc, said first plunger being attached to said third chamber and said first frangible disc separating said aqueous solution of mildly acidic salt from a porous wall of said first chamber, a first level of oxygen generation being activated by depressing said first plunger to rupture said first frangible disc, wherein subsequent to said rupture of said first frangible disc a repeated depression of said first plunger resulting from a first breathing rate causes an increase of pressure, thereby increasing a flow of said aqueous solution of mildly acidic salt through said porous wall and into said first chamber a second pressure means comprising a second plunger and a second frangible disc, said second plunger being attached to said fourth chamber and said second frangible disc separating said aqueous hydrogen peroxide from said porous wall of said first chamber, a second level of oxygen generation being activated by depressing said second plunger to rupture said second frangible disc, wherein subsequent to said rupture of said second frangible disc a repeated depression of said second plunger resulting from a second breathing rate causes an increase of pressure, thereby increasing a flow of said aqueous hydrogen peroxide to pass through said porous wall and into said first chamber.

2. An apparatus as defined in claim 1, further comprising a fifth chamber containing an immobilized sorptive particular material for selective absorption of noxious and other undesired gases which is cationically exchanged with a heavy metal ion, said fifth chamber being made from a semipermeable fabric.

3. An apparatus as defined in claim 2, wherein said semipermeable fabric of said fifth chamber is coated with an antioxidant.

4. An apparatus as defined in claim 3, wherein said antioxidant is selected from the group consisting of 2,6-di-tert-butyl-p-cresol, propyl gallate, t-butylhydroxy quinone, a butylated hydroxyanisole, and mixtures thereof.

5. An apparatus as defined in claim 2, further comprising a sixth chamber containing an antioxidant.

6. An apparatus as defined in claim 2, wherein said immobilized sorptive particulate material comprises a zeolite.

7. An apparatus as defined in claim 2, wherein said immobilized sorptive particulate material comprises a copper or iron exchanged clinoptilolite or copper or iron exchanged mordenite.

8. An apparatus as defined in claim 2, wherein said semi-permeable fabric of said fifth chamber is selected from the group consisting of an oriented, microporous teflon composite, an oriented, microporous polyolefin, a polyurethane, a water resistant nylon, and water resistant canvas.

9. An apparatus as defined in claim 2, wherein said oxygen generating compound is selected from the group consisting of alkali metal and alkaline earth metal peroxides, superoxides, trioxides, percarbonates, permanganates and mixtures thereof.

10. An apparatus as defined in claim 9, wherein said solid carbon dioxide absorber is lithium hydroxide.

11. An apparatus as defined in claim 9, wherein said oxygen generating compound is selected from the group consisting of potassium superoxide, lithium superoxide, calcium superoxide, sodium peroxide, potassium peroxide, lithium peroxide and mixtures thereof.

12. An apparatus as defined in claim 11, wherein said coating is selected from the group consisting of olefin copolymers with vinyl compounds, homopolymers of vinyl monomers, the alkyl, hydroxyalkyl and amino alkyl acrylics and methacrylics, maleic anhydrides, anhydrous polymeric alkylene oxide polyols and alkoxy derivatives having a molecular weight greater than 500, gelatins, starches, gums, polyamides, polyurethanes modified for high hydrophilicity, and mixtures of any of the foregoing.

13. An apparatus as defined in claim 11, wherein said mildly acidic salt is selected from the group consisting of magnesium chloride, calcium chloride, iron chloride, or zinc chloride.

14. An apparatus as defined in claim 13, wherein said microcapsules are from about 250 to about 1000 microns in diameter.

* * * * *